US011638985B2

(12) United States Patent
Brooks et al.

(10) Patent No.: US 11,638,985 B2
(45) Date of Patent: May 2, 2023

(54) CABLE TRAY HOLD-DOWN

(71) Applicant: Eaton Intelligent Power Limited, Dublin (IE)

(72) Inventors: David Charles Brooks, Greenville, IL (US); Matthew Thomas Combes, Greenville, IL (US); Jacob Lee Johnson, New Baden, IL (US); David Henry Petry, Jr., O'Fallon, IL (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 144 days.

(21) Appl. No.: 17/093,109

(22) Filed: Nov. 9, 2020

(65) Prior Publication Data

US 2021/0138611 A1 May 13, 2021

Related U.S. Application Data

(60) Provisional application No. 62/932,325, filed on Nov. 7, 2019.

(51) Int. Cl.

| | |
|---|---|
| ***B25B 5/10*** | (2006.01) |
| ***B25B 5/16*** | (2006.01) |
| ***B25B 5/14*** | (2006.01) |

(52) U.S. Cl.

CPC ..... *B25B 5/10* (2013.01); *B25B 5/145* (2013.01); *B25B 5/166* (2013.01)

(58) Field of Classification Search

CPC ..... B25B 5/10; B25B 5/101; B25B 5/145; B25B 5/16–166; B25B 5/006; F16B 2/06–12; H02G 3/263; H02G 3/32

See application file for complete search history.

(56) References Cited

U.S. PATENT DOCUMENTS

| | | | | |
|---|---|---|---|---|
| RE35,479 | E | 3/1997 | Witherbee et al. | |
| 6,098,942 | A | 8/2000 | Heath | |
| 7,104,024 | B1 * | 9/2006 | diGirolamo | E04B 2/96 403/231 |
| 8,534,625 | B2 | 9/2013 | Heath et al. | |
| 8,899,544 | B2 | 12/2014 | Meredith, Jr. | |
| 8,915,668 | B2 * | 12/2014 | Oetlinger | F16B 7/18 403/231 |
| 9,196,978 | B2 * | 11/2015 | Magno | H01R 4/36 |
| 9,239,067 | B2 | 1/2016 | Heath et al. | |
| 9,611,874 | B2 | 4/2017 | Heath et al. | |
| 10,451,198 | B2 * | 10/2019 | Lupsa | F16B 2/065 |
| 10,648,496 | B2 * | 5/2020 | Oetlinger | F16B 43/02 |

(Continued)

FOREIGN PATENT DOCUMENTS

JP 3616614 B2 * 2/2005

OTHER PUBLICATIONS

Machine translation of JP-3616614-B2 (Year: 2005).*

(Continued)

*Primary Examiner* — Lee D Wilson
*Assistant Examiner* — Robert F Neibaur
(74) *Attorney, Agent, or Firm* — Stinson LLP

(57) ABSTRACT

The present disclosure is related to a hold-down for a cable tray. The hold-down may be configured for high-wind situations. The hold-down includes a support clamp for clamping onto a support, and a hold-down arm for holding the cable tray on the support.

11 Claims, 16 Drawing Sheets

(56) References Cited

U.S. PATENT DOCUMENTS

| | | | | |
|---|---|---|---|---|
| 11,255,091 | B2 * | 2/2022 | Hatzinikolas | E04F 13/0853 |
| 2021/0324885 | A1 * | 10/2021 | Oh | F16B 2/065 |

OTHER PUBLICATIONS

OE Outside Fixing Claim User Guide, Oeglaend Systems, believed to be at least as early as Nov. 6, 2019, 1 page.
PW Ladder Cable Tray Clamp, 1893 Series, Legrand, believed to be at least as early as Nov. 6, 2019, 1 page.
Cable tray combo clamp Product Sheet, Thomas & Betts, 2007, 2 pages.
Pemsa Cable Management Solutions, Data Sheet "Connector Plate," http://www.pemsa-rejiband.com/catalog/en/n/W_PLA_UNN, downloaded Sep. 28, 2022, 2 pages.

* cited by examiner

CABLE TRAY HOLD-DOWN

FIELD OF THE DISCLOSURE

The present disclosure is related to a hold-down for a cable tray.

BACKGROUND OF THE DISCLOSURE

A cable tray is typically supported by a series of parallel supports (e.g., struts, C-Channel, I-beams, etc.) suspended at intervals and spaced lengthwise of the cable tray. The cable tray rests on these supports and is held in position on the supports by hold-downs which are affixed to the supports. These hold-downs are intended to retain the cable tray on the supports and to inhibit lateral shifting of the cable tray relative to the supports. Two types of hold-down members are common in the industry: one type acting as a clamp for rigidly clamping a cable tray against a corresponding support; and a second type acting as a guide which holds the cable tray loosely on the support to permit thermal expansion and contraction of the cable tray due to temperature variations. These hold-downs may not be suitable for high load applications, such as high wind applications. Instead, in such applications a penetrating fastener may be needed to secure the cable tray to the support. For example, a fastener may be driven through a lower flange of a rail of the cable tray and into the support.

BRIEF DESCRIPTION OF THE DRAWINGS

Corresponding reference characters indicate corresponding parts throughout the drawings.

DETAILED DESCRIPTION OF THE DISCLOSURE

The present disclosure is directed to a hold-down for a cable tray configured to retain the cable tray on a support. In one embodiment, the hold-down is non-penetrating (i.e., the hold-down does not extend through the cable tray or supports) and is configured for high-load applications, such as high wind applications. In this same embodiment, or another embodiment, the hold-down may be configured to retain the cable tray on an I-beam or other beam having a flange. The hold-down may be configured to clamp or otherwise attach to a flange of the I-beam. In this same embodiment, or another embodiment, the hold-down may be configurable between a clamp configuration, in which the hold-down engages or contacts a rail of the cable tray and functions as a clamp, and a guide configuration, in which the hold-down functions as a guide allowing some movement (e.g., expansion) of the cable tray relative to the support.

Figure 1:
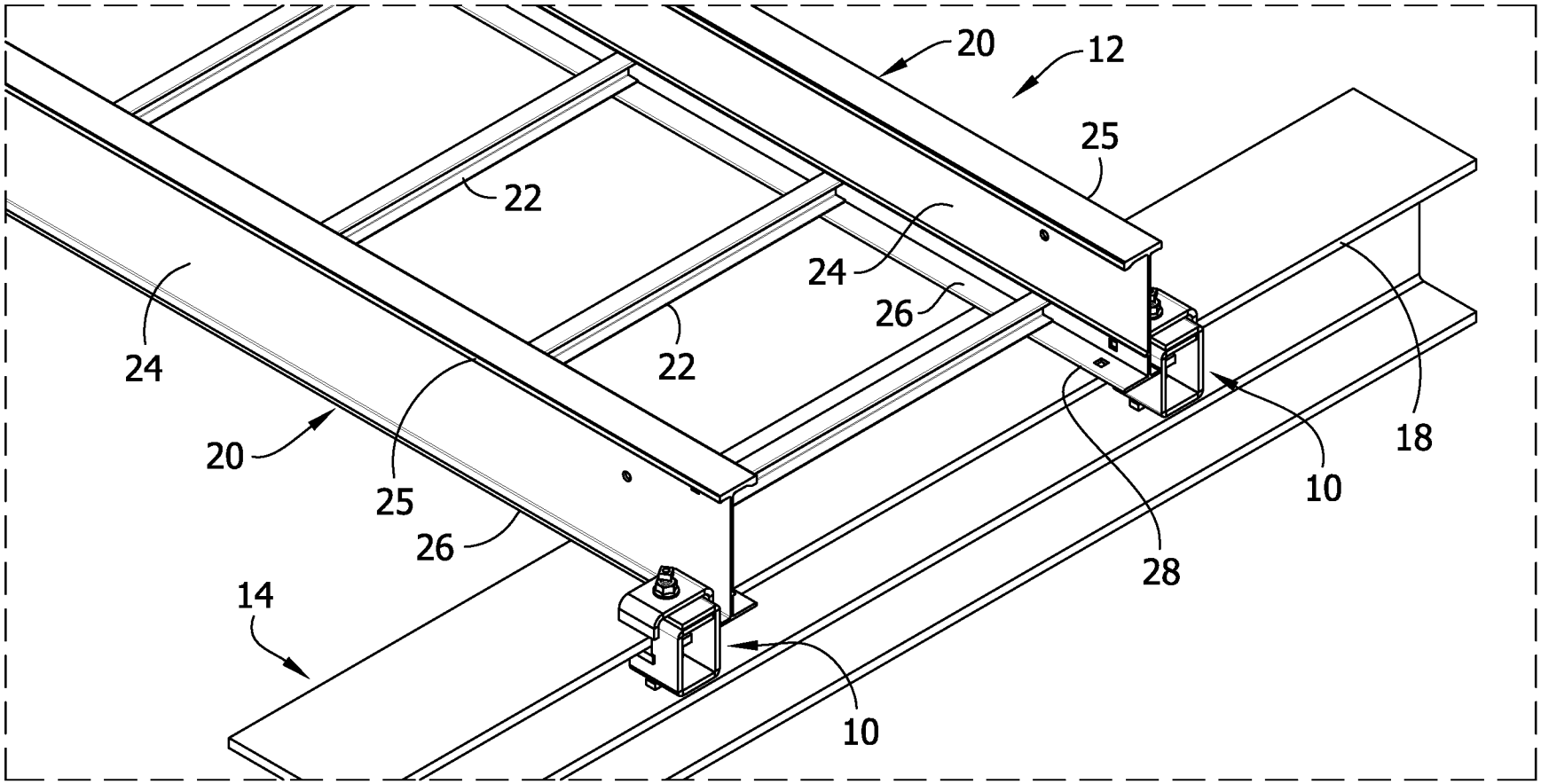
FIG. 1 is a perspective view of a cable tray being retained on a cross support by a pair of hold-downs of the present disclosure.
Figure 4:
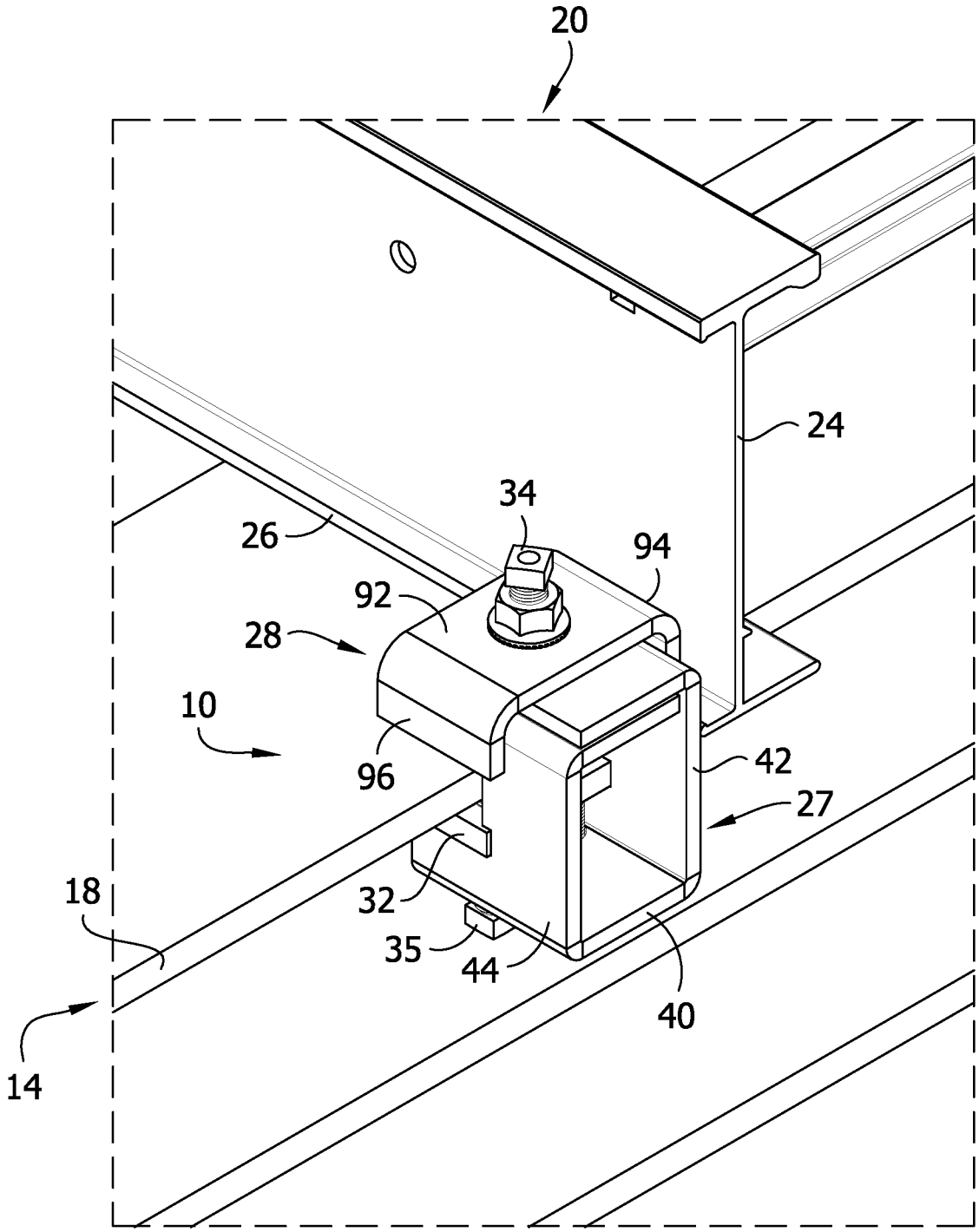
FIG. 4 is an enlarged, fragmentary view of FIG. 1 showing one of the hold-downs in a clamp configuration.
Figure 5:
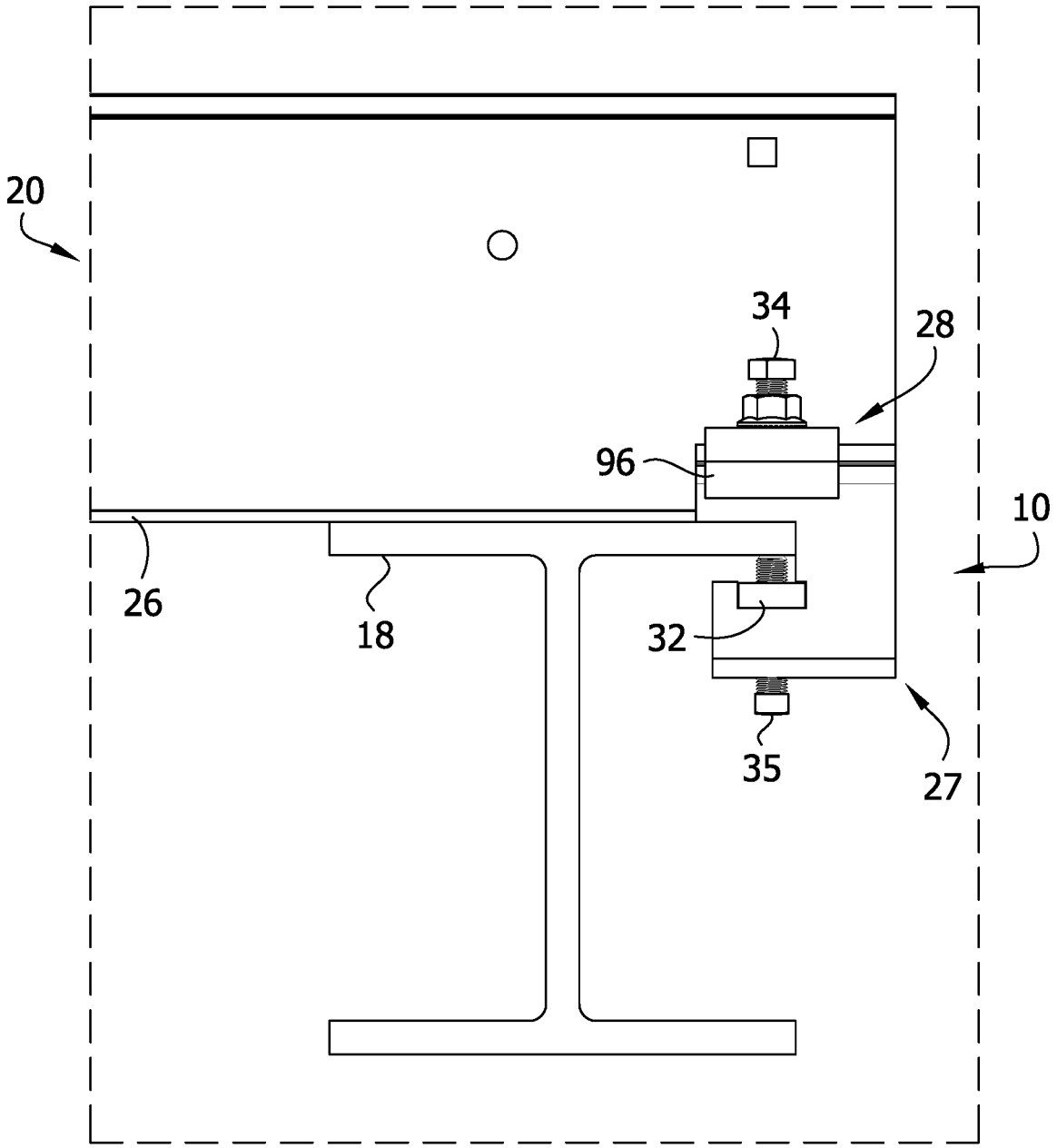
FIG. 5 is a side view of the FIG. 4.
Figure 6:
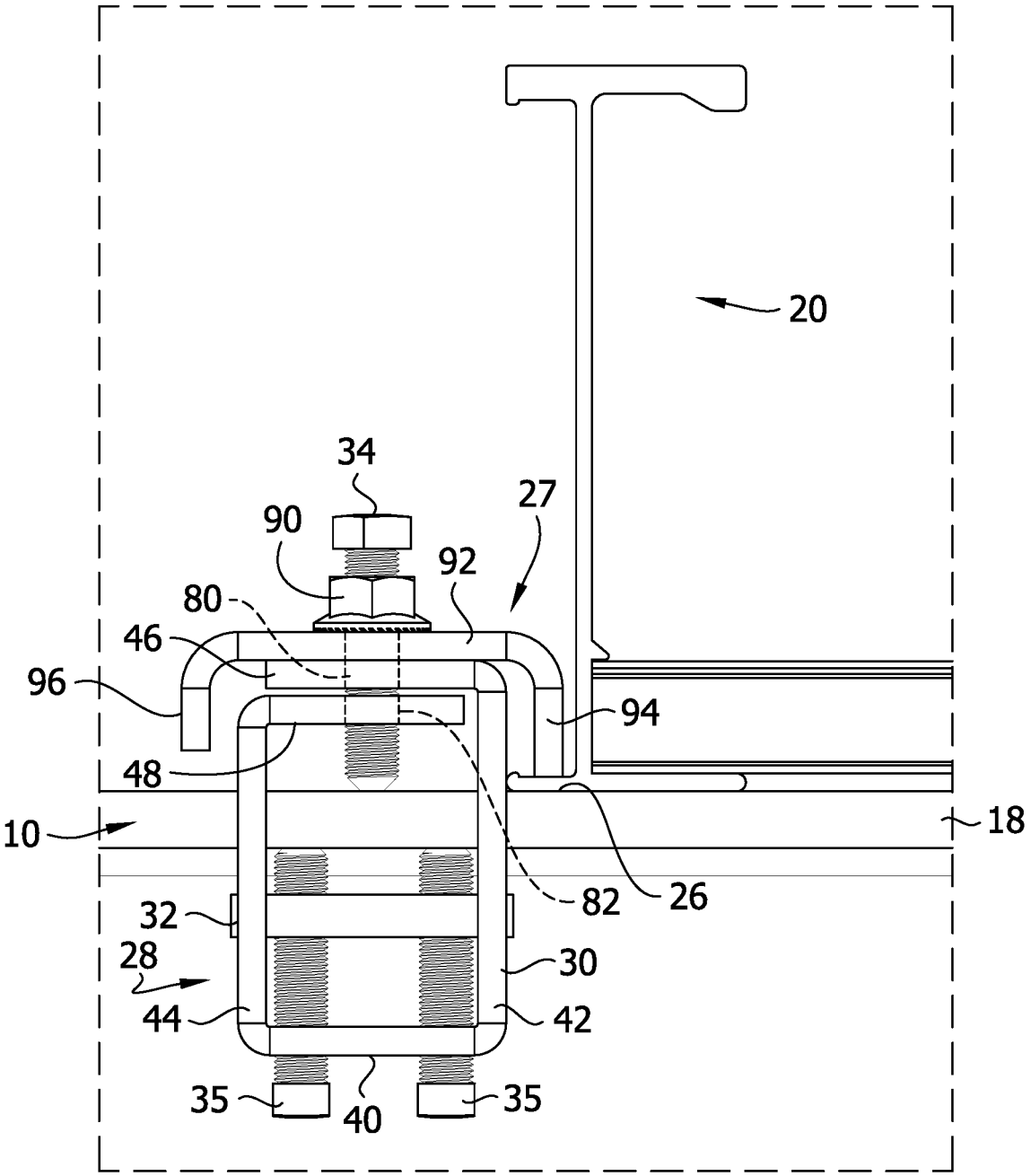
FIG. 6 is a front elevation of FIG. 4.
Figure 7:
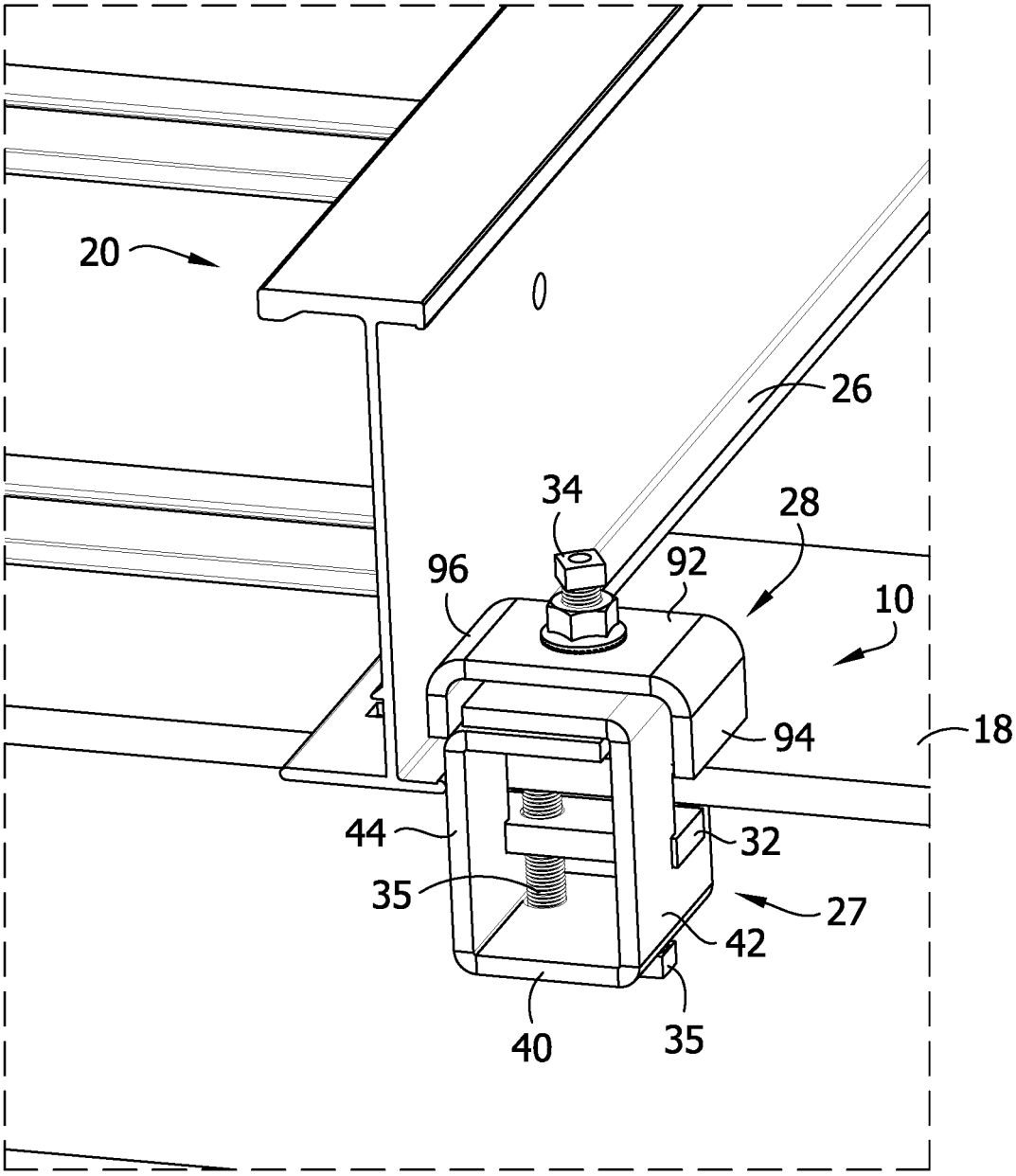
FIG. 7 is an enlarged, fragmentary view of FIG. 1 showing the other the hold-down in a guide configuration.
Figure 8:
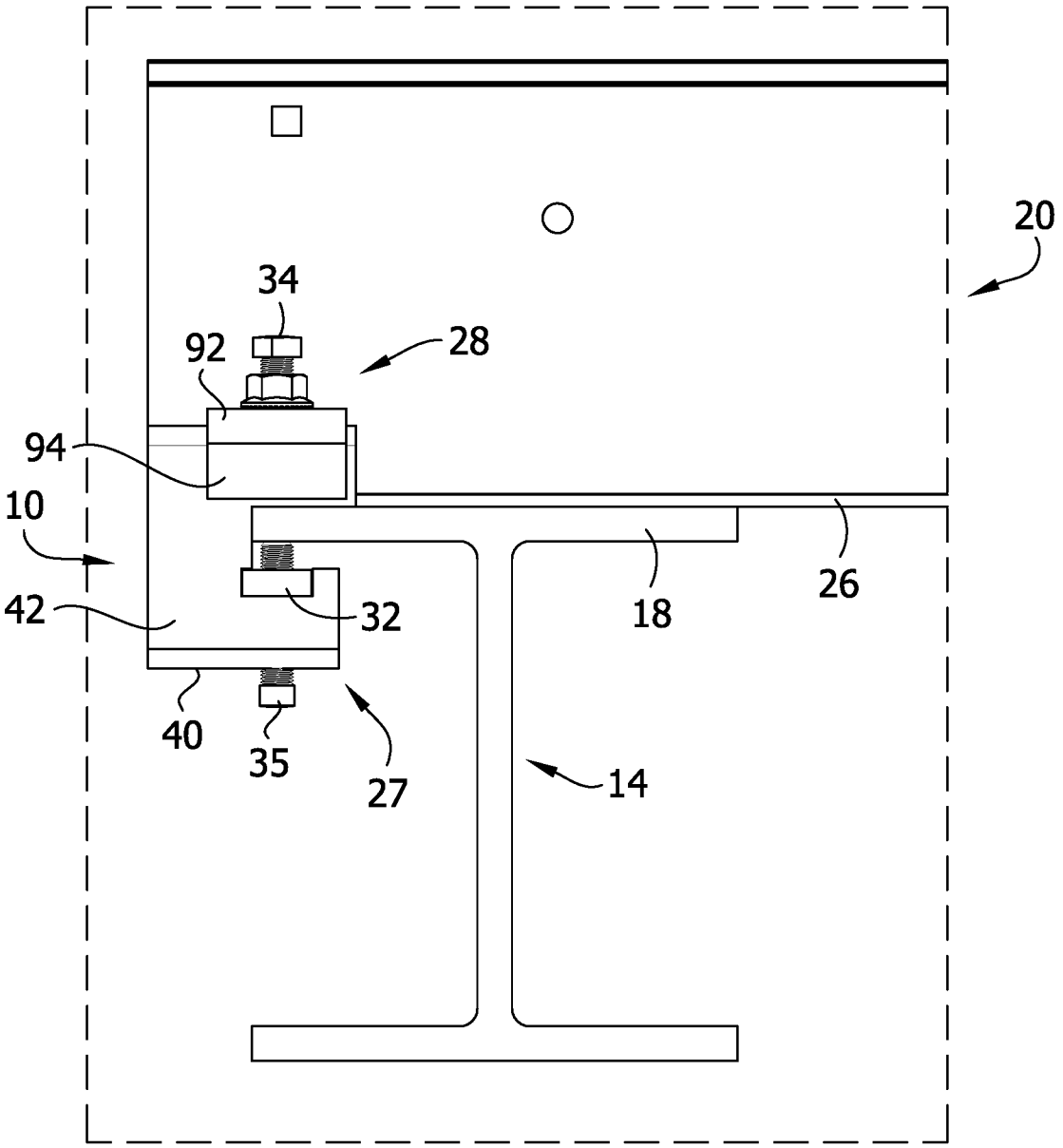
FIG. 8 is a side view of the FIG. 7.
Figure 9:
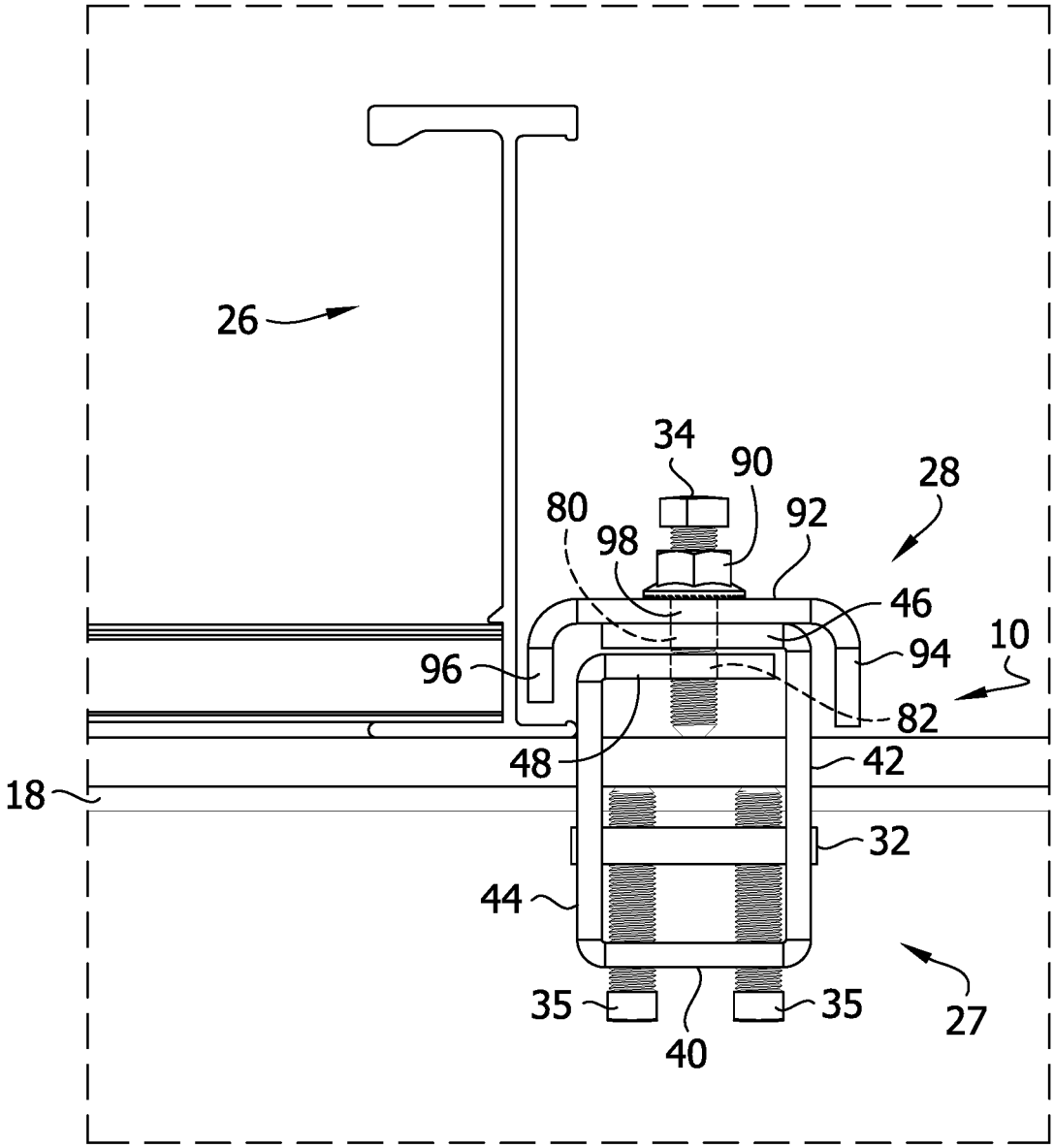
FIG. 9 is a front elevation of FIG. 7.
Figure 10:
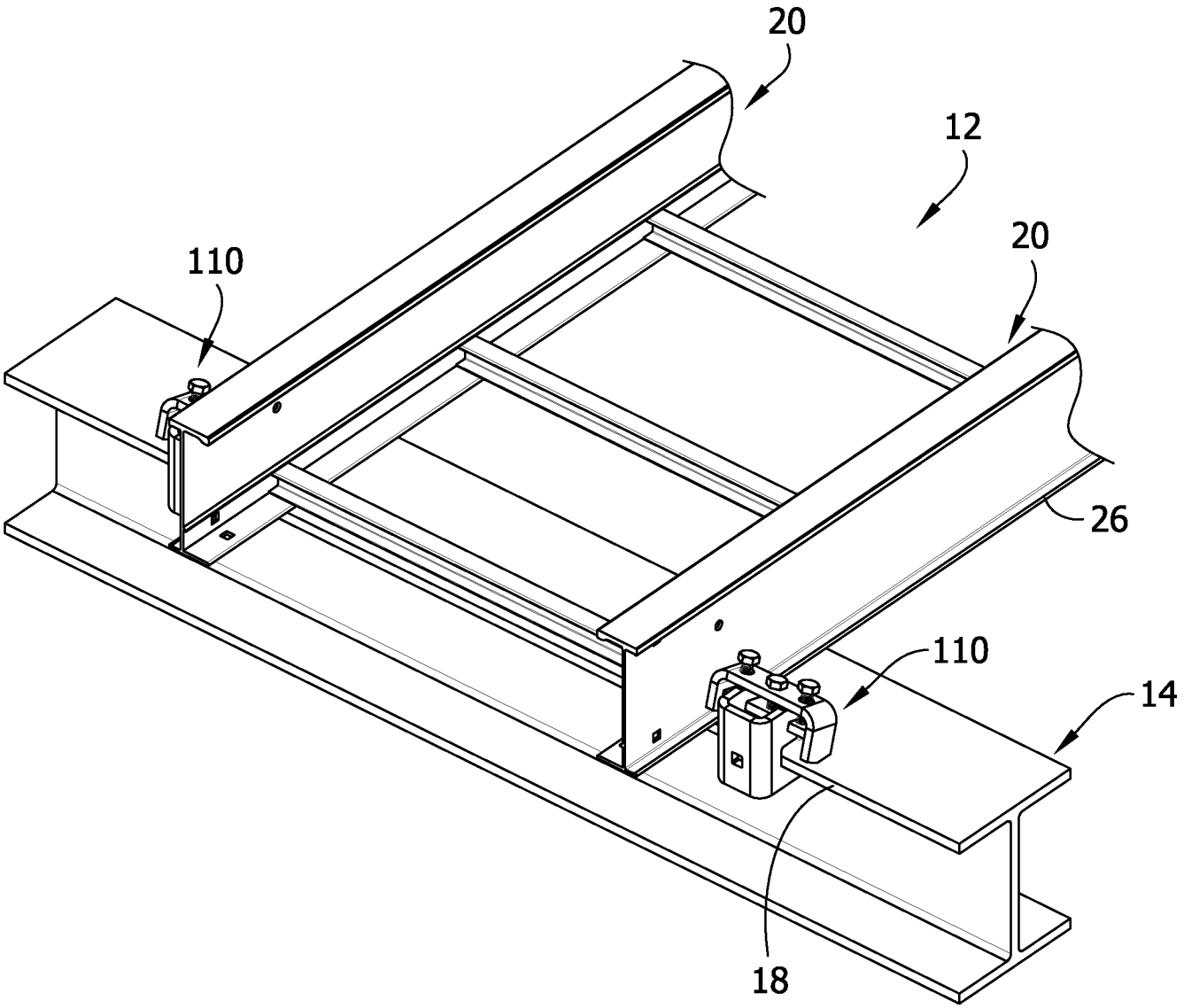
FIG. 10 is a perspective view of a cable tray being retained on a cross support by a pair of hold-downs of another embodiment of the present disclosure.
Figure 11:
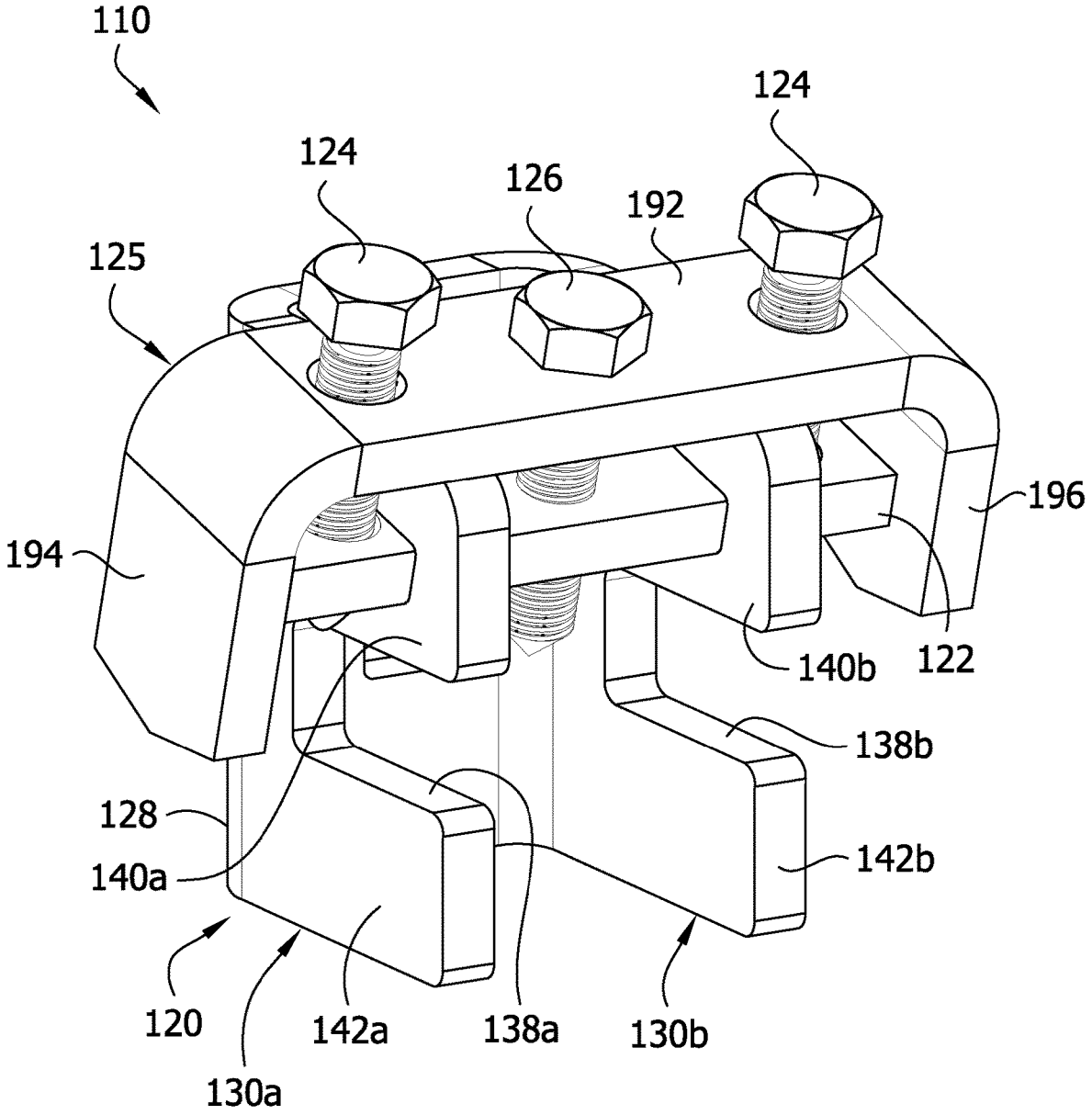
FIG. 11 is an enlarged perspective of the hold-down.

A hold-down having each of the above-features is indicated generally at reference numeral 10 throughout the drawings. Referring to FIG. 1, a pair of the hold-downs 10 are used to retain a cable tray, generally indicated at 12, on a support, generally indicated at 14. In the illustrated embodiment, the support 14 is an I-beam having an upper flange 18. The illustrated cable tray 12 is of the type comprising a pair of generally parallel side rails, each generally indicated at 20, interconnected by a series of parallel, spaced apart cross members 22. The cross-sectional shape of the rails 20 may vary depending on the type of cable tray 12. For example, the illustrated rails 20 are I-beams (e.g., aluminum I-beams), each having a vertical web 24 and upper and lower horizontal flanges, indicated at 25 and 26, respectively, extending laterally outward from the web, such as on opposite sides of the web. The cable tray 12 may be adapted to carry various types of conduit. For purposes of illustration, one of the hold-downs 10 is shown in the clamp configuration, as also shown in FIGS. 4-6, and the other hold-down 10 is shown in the guide configuration, as also shown in FIGS. 7-9. It is understood that in use typically each of the hold-downs would be in the same configuration.

Figure 2:
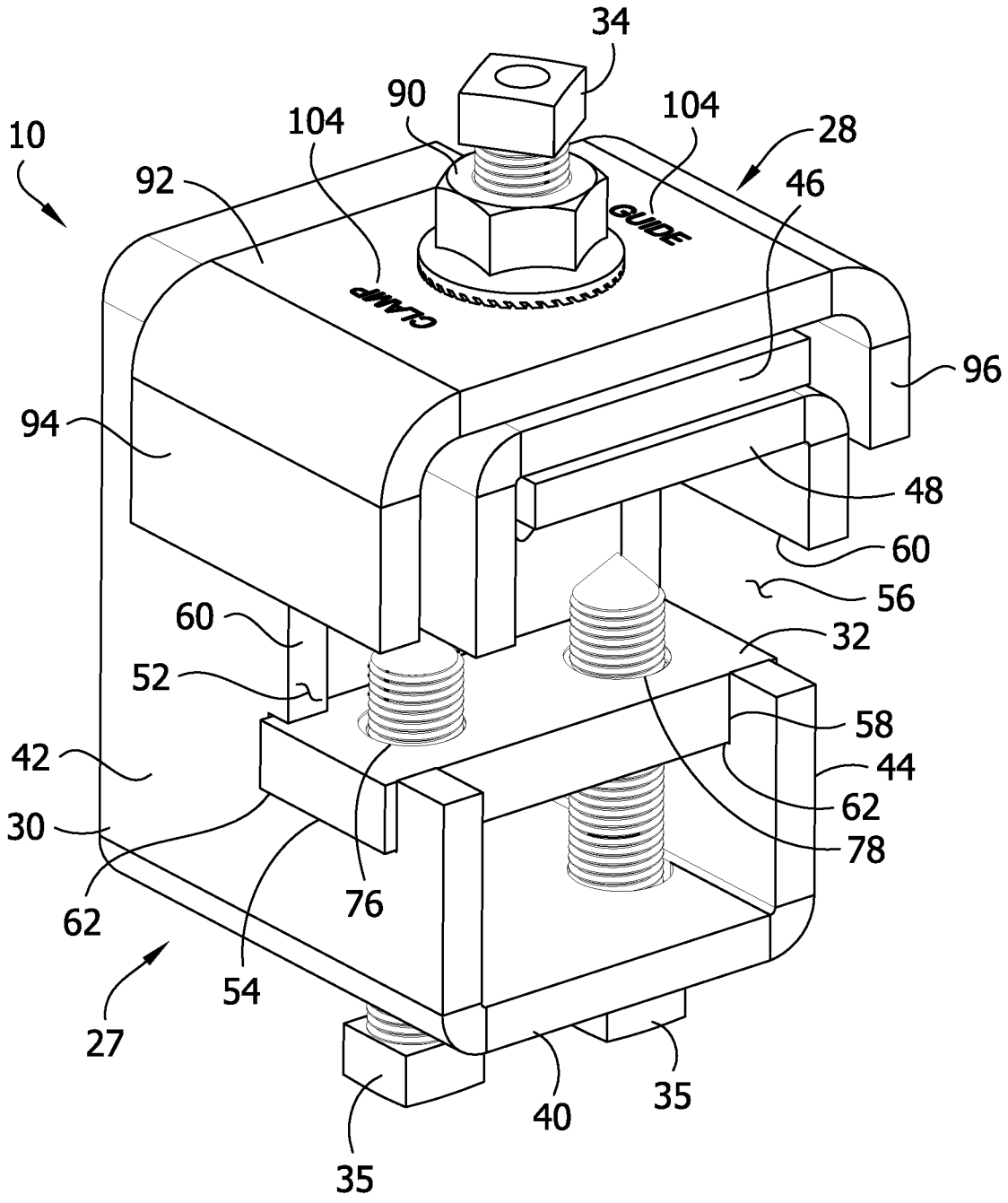
FIG. 2 is an enlarged perspective of the hold-down.
Figure 3:
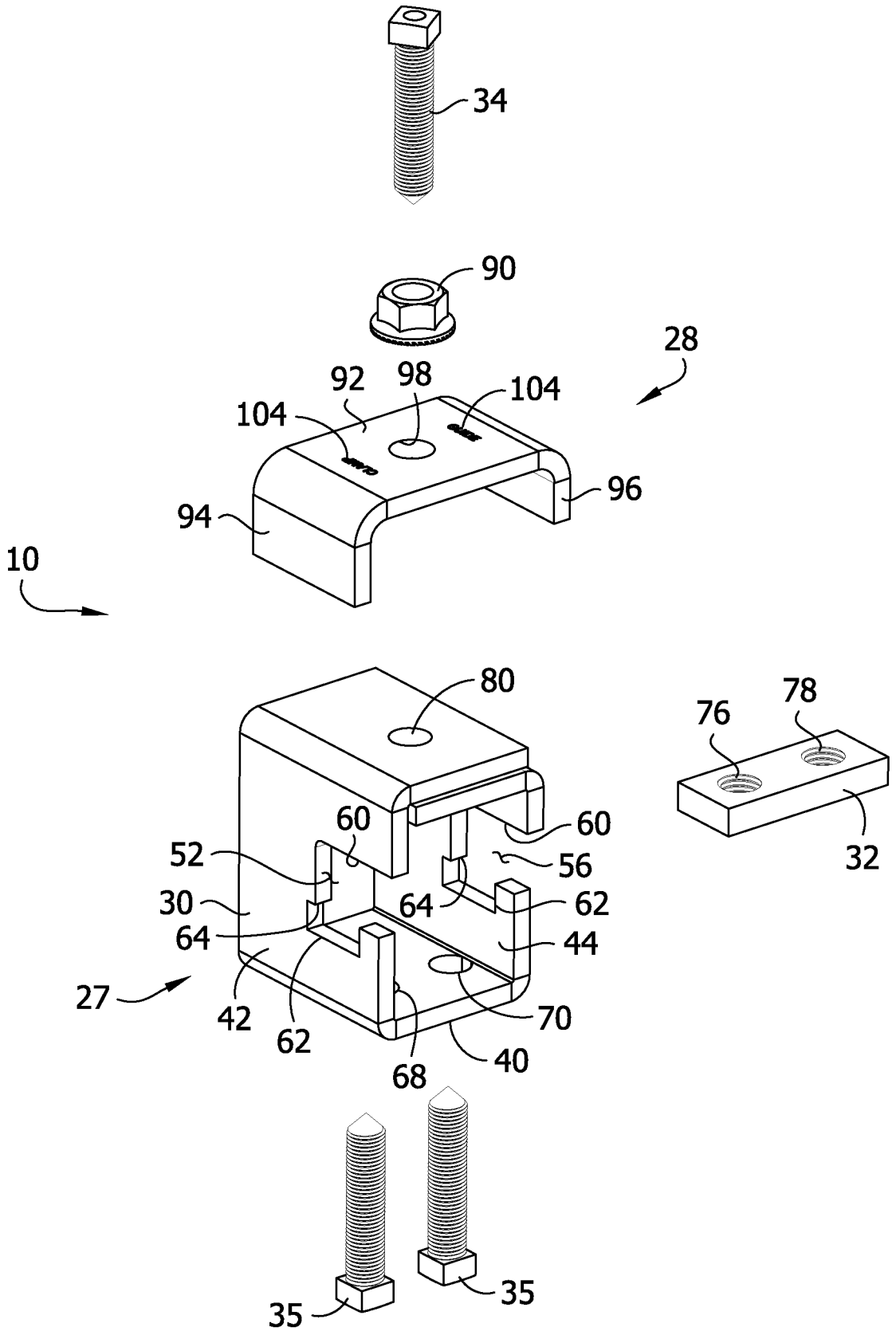
FIG. 3 is an exploded perspective of the hold-down.

Referring to FIGS. 2 and 3, the illustrated hold-down 10 comprises a support clamp, generally indicated at 27, and a hold-down arm, generally indicated at 28, secured to the support clamp. The support clamp 27 includes a main body 30, an insert 32 and one or more upper and lower threaded fasteners 34, 35. In the illustrated arrangement, the main body 30, the insert 32 and the threaded fasteners 34, 35 are all separate components from one another. However, other configurations also are possible. The insert 32 is a set screw bar that cooperates with the main body 30 to support one or more of the threaded fasteners 35. In particular, the insert 32 receives two of the threaded fasteners 35 and transfers a load from the fasteners to the main body 30. The fasteners 34, 35 secure the main body 30 to the beam or other support 14 thereby providing a multiple point (e.g., a three point) mechanical connection between the hold-down 10 and the beam. The upper fastener 34 also secures the hold-down arm 28 to the main body 30 of the support clamp 27. The upper and lower fasteners 34, 35 can be aligned with one another in longitudinal and/or lateral directions of the hold-down 10, or the fasteners 34, 35 can be offset from one another.

Referring still to FIGS. 2 and 3, the main body 30 generally comprises a bottom wall 40. The main body 30 also comprises a first side wall 42 and a second side wall 44. The first side wall 42 extends upward from the bottom wall 40 and the second side wall 44 extends upward from the bottom wall 40. The first and second side walls 42, 44 can be mirror images of one another. A first top wall 46 extends inwardly from an upper portion of the first side wall 42, and a second top wall 48 extends inwardly from an upper portion of the second side wall 44. The illustrated main body 30 is hollow and generally rectangular in cross-sectional shape. Preferably, the first top wall 46 and second top wall 48 overlap one another along at least a majority portion, e.g., substantially entirety, thereof.

The terms "top," "bottom," "side" and the like are merely used to provide a frame of reference for this written description. The structures and component described herein can be mounted in any particular orientation and, therefore, the usage of these terms should not be considered limiting in any manner. Other relative or directional terms may be used herein. These terms are used in the context of the particular orientation(s) shown and should not be considered as limiting the structures to the illustrated orientation in actual use.

The main body 30 may be formed from a single plate or sheet of material. In other words, the main body 30 preferably is formed as a monolith or single structure and each of the walls 40, 42, 44, 46, 48 is integrally related. Stated yet another way, each of the adjoining walls (e.g., the top wall 40 and the first side wall 42) is connected at a bend. Other configurations are possible.

The first side wall 42 has an elongated first slot 52 extending through an edge 54 of the first side wall 42. Similarly, the second side wall 44 has an elongated second slot 56 extending through an edge 58 of the second side wall 44. The slots 52 and 56 preferably are aligned in a vertical direction and open in the same direction such that the main body 30 defines a jaw-like shape with a mouth configured to receive a flange 18 of the I-beam 14, for example. The slots 52 and 56 may generally define an L-shape or J-shape when viewed from the side. A first, preferably rectangular, portion 60 of each of the slots 52 and 56 is configured to receive the flange of the beam or a portion of another support member 12. A second, preferably rectangular, portion 62 of each respective slot 52 and 56 that is above, is sized and shaped to receive the insert 32. The second portion 62 opens into the first portion 60 of each slot 52 and 56. A support surface or shoulder 64 is defined at a juncture between the first portion 60 and second portion 62 of each slot 52 and 56 so that a portion of the insert 32 can rest on the shoulder when assembled. The first portion 60 and second portion 62 may each be formed by separate slots or openings.

The bottom wall 40 has a pair of holes 68, 70 sized to accommodate the fasteners 35 and, preferably, are somewhat, but not substantially, larger than the outer diameter of the shaft portion of the fasteners 35. Thus, the holes 68, 70 limit radial movement of the fasteners 35. Preferably, the holes 68, 70 are defined by relatively smooth walls. That is, preferably, the holes 68, 70 are not threaded.

The insert 32, which can be referred to as a locking bar, is generally elongated and rectangular with a first end positioned in the second portion 62 of the slot 52, and a second end positioned in the second portion 62 of the slot 56. The insert 32 is in a generally perpendicular relation to the side walls 42, 44 and partially rests on the shoulder 64. The insert 32 has one or more threaded holes to accommodate the threaded fasteners 35. Preferably, the insert 32 has a pair of threaded holes 76 and 78 adjacent to the side walls 42 and 44, respectively, and are aligned with the holes 68 and 70, respectively, when the insert 32 is positioned in the main body 30. Thus, the threaded fasteners 35 preferably pass through a respective one of the holes 68, 70 and threadably engage a respective one of the threaded holes 76, 78. With the insert 32 partially resting on the shoulder 64, the threaded fasteners 35 engaging the insert 32 and the holes 68, 70 of the main body 30 inhibiting substantial movement of the threaded fasteners 35, the insert 32 preferably is held in place within the second portions 62 of the slots 52, 56. That is, the interaction between the threaded fasteners 34 and the holes 68, 70 restricts a forward end of the insert 32 from rotating in a downward direction, thereby inhibiting removal of the insert 32 from the second portions 62 of the slots 52, 56. Conveniently, the insert 32 is held in place even with the threaded fasteners 35 backed off to ease assembly of the sway brace attachment 10 to the support, as described further herein.

The first top wall 46 has a first opening 80 and the second top wall 48 has a second opening 82 that are aligned with one another (FIGS. 6 and 9). In the illustrated arrangement, the first opening 80 and the second opening 82 are also aligned in a forward-rearward direction with the openings 68, 70 of the top wall 40. Preferably, the openings 80, 82 are centered or substantially centered in a width direction of the main body 30. The first opening 80 and the second opening 82 are configured to accommodate the threaded fastener 34. One of the first opening 80 and the second opening 82 may be threaded and the other of the first opening 80 and the second opening 82 may be unthreaded. In the illustrated arrangement, the first opening 80 of the first top wall 46 (i.e., the relative upper one of the top walls 46, 48) is threaded and the second opening 82 of the second top wall 48 (i.e., the relative lower one of the top walls 46, 48) is not threaded or is unthreaded. However, in other arrangements, this order could be reversed or both openings 80, 82 could be threaded. The presence of the threaded fastener 34 within the openings 80, 82 inhibits or prevents significant relative movement between the first top wall 46 and the second top wall 48. In particular, lateral movement of the top walls 46, 48 is inhibited or substantially prevented to inhibit or substantially prevent spreading of the top walls 46, 48 and side walls 42, 44 of the main body 30, thereby maintaining the strength of the hold-down 10. Thus, the unthreaded opening 80 or 82 (if any) is sized relatively closely to the outside diameter of the shaft portion of the fastener 34. Although the fastener 34 may be provided as a means of coupling the top walls 46, 48 to inhibit or at least substantially prevent spreading of the bottom walls 46, 48, other suitable mechanisms can also be used for this purpose, including fasteners (e.g., rivets, screws) that do not contact the flange, clamps, welding, interference structures and other suitable arrangements for fixing the top walls 46, 48 relative to one another.

In the illustrated arrangement, the upper threaded fastener 34 (i.e., the threaded fastener passing through the upper walls 46, 48) includes a nut/washer combination 90 threadably engaging a threaded shaft portion of the fastener 34. The upper threaded fastener 34 can alternatively comprise a nut without a washer or separate nut and washer.

The hold-down arm 28 of hold-down 10 includes a base 92 having first and second longitudinal ends. The base 92 can be generally rectangular in shape. Opposite first and second wings 94, 96 extend generally transverse to a longitudinal axis of base 92 beginning at the respective first and second ends of the base 92. Together, interior faces of the base 92 and wings 94, 96 define a general U-shape and are sized and shapes to nest on top of support clamp 27, in particular, to nest on top of top wall 46 of support clamp 27. A fastener opening 98 extends through base 92 and is generally aligned with openings 80, 82 of top walls 46, 48, respectively.

The first wing 94 extends further downward than the second wing 96 to define a clamping portion. The clamping portion is configured to engage and clamp the lower flange 26 of rail 20. In the illustrated embodiment, the clamping portion extends downward at an angle of about 90 degrees relative to the base 92, although it will be understood that the clamping portion could extend downward at a variety of angles. As illustrated in FIGS. 4-6, the hold-down 10 is shown as mounted in the clamping configuration in which a portion of the base 92 overlies the lower flange 26 of the cable tray 12 and the first wing 94 is in clamping engagement with the flange 26 of the cable tray 12, thereby holding the rail 20 of the cable tray 12 in a fixed position relative to support 14.

Referring to FIGS. 7-9, the second wing 96 comprises the guide. In this configuration, the second wing 96 is not in clamping engagement with the rail 20 to permit free lengthwise thermal expansion and contraction of the rails relative to the support. The length of the second wing 96 is preferably sufficient to enable the second wing 96 to clear (but only slightly), the bead adjacent the outer edge of the lower flange 26. In this way, the second wing 96 is generally shorter in length than the first wing 94.

As can be understood and seen by FIGS. 4-9, the hold-down arm 28 can be orientated in either the clamp configuration (FIG. 6) or the guide configuration (FIG. 9) by merely rotating the hold-down arm 28 about a transverse axis extending transverse to the length of the hold-down 10 and through the opposite faces of the hold-down 10 so that either the clamp (first wing 94) engages the rail 26 or the guide (second wing 96) extends over the rail 26. There is no need to invert or flip over the hold-down arm 28. This makes orientating the hold-down easier and faster for the installer. To further enhance ease of use for the installer, the base 92 of the hold-down arm 98 can contain indicia 104 to indicate which side (i.e., which of the first and second wings 94, 96) functions as the clamp configuration and which functions as the guide configuration. This indicia 104 can also be contained on any other part of the hold-down 10 to indicate to the installer the proper orientation, for example, on first and second wings 94, 96.

The main body 30, the insert, or locking bar, 32, and the hold-down arm 28 can be fabricated from hot-rolled, low-carbon steel to meet the standards set by the Underwriters Laboratories (U.L.), Factory Mutual Engineering (F.M.), or other such quality control groups, though other suitable materials may also be used. Additionally, the main body 30 and the insert 32 may have a plain or electro-galvanized finish.

The threaded fasteners 34, 35 may also be referred to herein as set screws. Preferably, each threaded fastener 34, 35 has a head portion and a threaded portion. As described, the threaded fasteners 35 extends through holes 68, 70, respectively, and are threaded into the holes 76 and 78 of the insert 32, thereby capturing the insert 32 within the slots 52, 56. The set screws 35 are long enough to be threaded through the insert 32 to engage a flange, or other structure, positioned in the slots 52, 56. Another set screw 34 preferably extends through the holes 80 and 82 of the upper walls 46 and 48, respectively, and hole 98 of hold-down arm 28. This set screw 34 is long enough to engage the flange, or other structure, positioned in the slots 52, 56. Each of the set screws 34 has an end, which preferably is in the form of a relatively sharp cone point for engaging the flange, or other structure. The cone point facilitates the set screws 34 in creating a deformation in the flange, or other structure, to increase the bite of the set screw 34 in the flange, or other structure, to inhibit or prevent sliding movement of the set screw 34. The cone point does not necessarily need to possess a sharp point. A small flat surface at the end can be permissible. Preferably, any flat surface at the end 96 is less than about 0.05 inches, less than about 0.04 inches or less than about 0.031 inches. In other arrangements, the end can be a cup point or other type of end structure, if needed or desired.

The screw head may be adapted to break off at a particular torque level or particular torque range, which may be a threshold or predetermined torque level or range. This feature is a convenient method for ensuring that the set screw 34 has been properly torqued or tightened. A portion of the shaft of the set screw 34 can include a reduced cross-section portion. The reduced cross-section portion can have a particular minimum diameter (or cross-sectional dimension for non-circular shapes) selected in view of the material properties, heat treatment and/or other relevant factors such that the screw head will break off at a particular torque level, which may be a particular minimum value or a range of values. In one or more embodiments, the screw head may not be configured to break off.

In the illustrated embodiment, the main body 30 is about 0.25 inches thick. The overall peak dimensions of the main body 30 are about 3.5 inches high, 2.375 inches wide, and 3 inches long. The lower wall 40 is preferably about 2.375 inches wide and spaces the inner surfaces of the side walls 42 and 44 by about 1.875 inches. The side walls 42 and 44 preferably have a peak height of about 3.5 inches. The first portions 60 of the slots 52 and 56 have dimensions of about 1.5 inches by about 0.9 inches (length by height). With such dimensions, the hold-down 10 is capable of use with flanges between about ⅜ inch and ⅞ inch thickness. The second portions 62 of the slots 52 and 56 have dimensions of about 1.031 inches by about 0.39 inches (length by height). The rearward ends of the first portions 60 and second portions 62 are offset from one another such that the shoulder 64 has a length of about 0.156 inches. The bottom wall 40 and lower portions of the side walls 42, 44 below the slots 52, 56 have a length (in a forward-rearward direction) of about 2.75 inches. The top walls 46, 48 and upper portions of the side walls 42, 44 above the slots 52, 56 have lengths of about 3 inches. Thus, the lower portions of the edges 54, 58 of the side walls 42, 44 below the slots 52, 56 are offset in a rearward direction from the lower upper of the edges 54, 58 of the side walls 42, 44 above the slots 52, 56 by a distance of about 0.25 inches in a forward-rearward direction. The lengths of the first portions 60 of the slots 52, 56 are measured from the upper portions of the edges 54, 58. The upper top wall 46 has a width of about 1.841 inches and a length of about 3 inches. The lower top wall 48 has a width of about 1.966 inches and a length of about 3 inches. A vertical gap between the upper top wall 46 and the lower top wall 48 is about 0.063 inches. The holes 68, 70 have diameters of about 0.531 inches. The centers of the holes 68, 70 are spaced about 0.891 inches rearward of the forward edge of the bottom wall 40, about 1.313 inches from one another and about 0.531 inches from the side edges of the top wall 40. The centers of the holes 80 and 82 are spaced about 1.141 inches from the front edges of the top walls 46, 48 and substantially centered in the lateral direction of the walls 46, 48 and/or along the center line of the main body 30. The threaded hole 80 has a diameter of about 0.5 inches and the unthreaded hole 82 has a diameter of about 0.563 inches.

The insert 32 may be about 0.375 inches thick, about 1 inch wide (forward-rearward or length direction of the assembled sway brace attachment 10) and about 2.5 inches in length (lateral or width direction of the hold-down 10), which permits it to fit comfortably in the second portions 62 of the slots 52, 56 and slightly extend outwardly side walls 42, 44 when the insert 32 is placed in the main body 30. The spacing between the threaded holes 76 and 78 may be about 1.313 inches, which disposes them in substantial alignment with the holes 68 and 70, respectively. The threaded holes 76, 78 comprise standard ½-inch female threads.

The threaded portion of each set screw 34 comprises standard ½-inch threads. The shaft portion of the set screw 34, including the threaded portion, end and reduced cross-section portion can be about 2.5 inches in length, so that the cone point can extend into the area defined between the slots 52 and 56. The reduced cross-sectional portion can have a length of about 0.188 inches. The set screws 34 can be fabricated from a hardened carbon steel, though other suitable materials may be used. Of course, those skilled in the art will recognize that these and other dimensions presented herein are illustrative of one preferred embodiment, and that the present disclosure may be alternatively dimensioned with efficacy, as required or desired.

The hold-down 10 is capable of withstanding a large force in multiple directions. For example, the hold-down 10 is capable of withstanding a large force applied transverse to the longitudinal axis of the cable tray 12 away from the support and transverse to the axis of support 14 away from the support ("tray pull-off" load). The hold-down 10 is also capable of withstanding a large force applied transverse to the longitudinal axis of the cable tray 12 and along the longitudinal axis of support 14 ("across the tray" load). Either or each of the tray pull-off load and the across the tray load may be over 2,000 lbf. (8,896 N), over 2,250 lbf. (10,008 N), over 2,500 lbf. (11,121 N), over 2,750 lbf. (12,233 N), over 3,000 lbf. (13,345 N), over 3,250 lbf. (14,457 N), or over 3,500 lbf. (15,569 N), for example, from 2,000 lbf. to 5,500 lbf. (8,896 N to 24,688 N), from 2,250 lbf. to 5,500 lbf. (10,008 N to 24,688 N), from 2,500 lbf. to 5,500 lbf. (11,121 N to 24,688 N), from 2,750 lbf. to 5,500 lbf. (12,233 N to 24,688 N), from 3,000 lbf. to 5,500 lbf. (13,345 N to 24,688 N), from 3,250 lbf. to 5,500 lbf. (14,457 N to 24,688 N), or from 3,500 lbf. to 5,500 lbf. (15,569 N to 24,688 N) in either or both the clamp and guide configurations.

Also provided herein is a method of securing a cable tray to a support, such that the cable tray is able to withstand a large force. The method generally comprises positioning the hold-down 10 in the correct configuration (i.e., clamp configuration or guide configuration) relative to the lower flange 26 of the rail 20 of cable tray 12 and sliding slots 52 and 56 of the support clamp 27 over the flange 18 of support 14, as shown in FIG. 1. The lower set screws 35 (i.e., the set screws that engage the insert 32) are inserted through respective holes 68 and 70 in the main body 30 and threaded into holes 76 and 78 in the insert 32 until the cone points of set screws 35 make contact with the flange. The set screws 35 can be tightened until their heads break off, whereby the set screws 35 securely contact the flange. Before or after inserting set screws 35, the hold-down arm 28 is aligned with support clamp 28 and the upper set screw 34 is inserted through fastener openings 80, 82, and 98. The upper set screw 34 (e.g., the set screw that engages the main body 30) is tightened until its head breaks off. This results in the hold-down 10 being securely fastened to the flange 18 of the support 14. As described, the provision of upper and lower set screws 34, 35 increases the bite of the hold-down 10 on the flange 18 of support 14 to increase resistance to overturning (rotation) of the hold-down 10. This method allows the cable tray to securely withstand large forces as described herein.

Referring to FIGS. 10-16, another embodiment of a hold-down capable of withstanding a large force in multiple directions, as described above, is generally indicated at reference numeral 110. The hold-down generally includes a support clamp, generally indicated at 120, and a hold-down arm, generally indicated at 125, coupled to the support clamp. The support clamp includes a clamp body 121, a set screw bar 122 coupled to the body, and at least one set screw 124 (e.g., two set screws or more than two set screws) coupled to the set screw bar. The illustrated body 120 is generally C- or channel-shaped, although it may be of other shapes. The illustrated body 121 includes a back wall 128 and opposing left and right side walls, generally indicated at 130*a*, 130*b*, respectively, extending forward from the back wall. Together, the back wall 128 and the side walls 130*a*, 130*b* define an open channel 129 having open upper and lower ends and an open front side. In the illustrated embodiment, the body 120 is integrally formed as a one-piece, monolithic component. For example, the body 120 may be fabricated from sheet metal, such as steel or other metal, as would be readily apparent by one of ordinary skill in the art.

Figure 12:
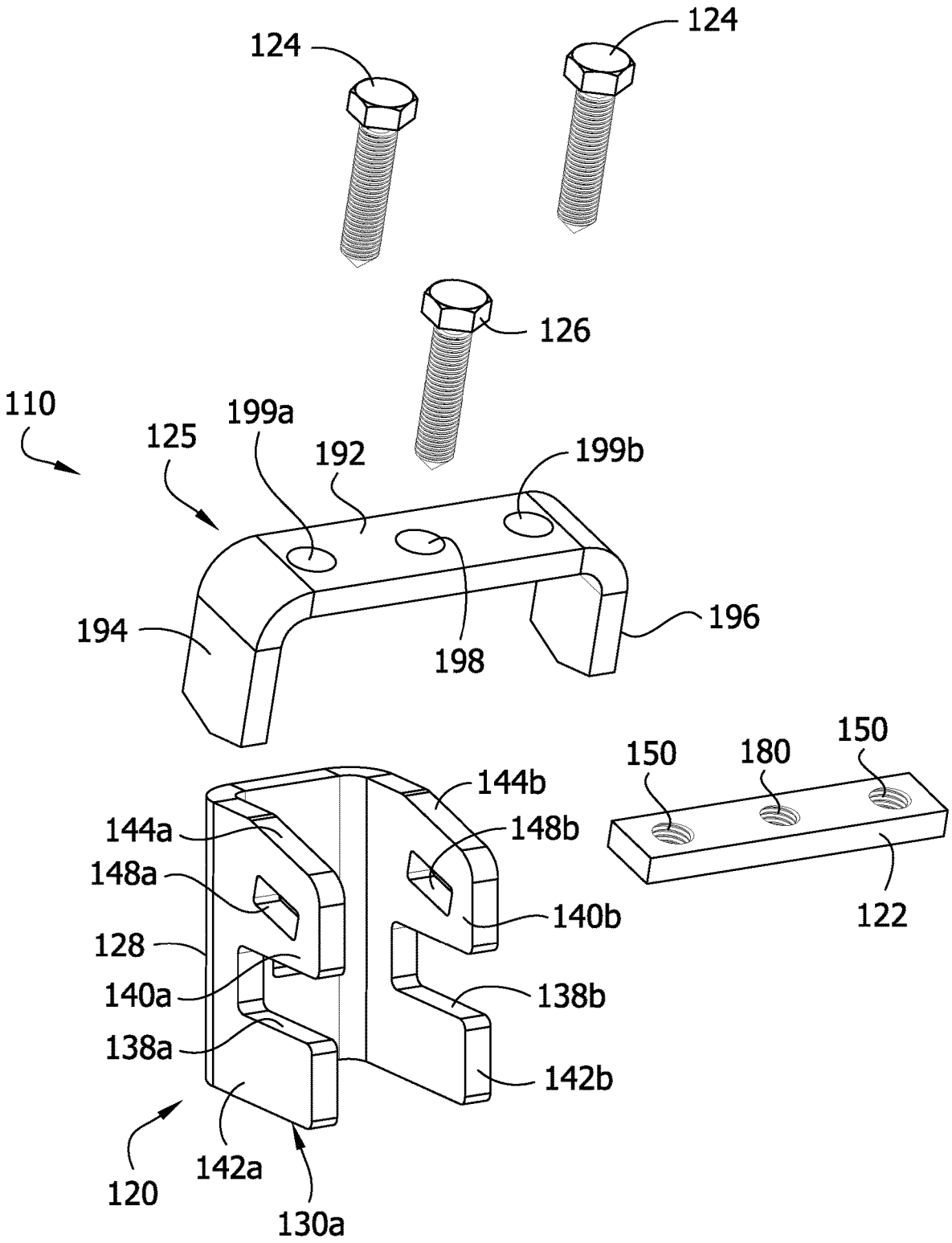
FIG. 12 is an exploded perspective of the hold-down.

The left and right side walls 130*a*, 130*b* define slots 138*a*, 138*b*, respectively, extending through a front of the respective side walls toward the back wall 128. The slots 138*a*, 138*b* are generally aligned with and oppose one another and are sized and shaped to receive a flange (or other portion) of the structural support (e.g., a flange of a beam, such as an I-beam). Accordingly, the left and right side walls 130*a*, 130*b* may be generally C-shaped. The left and right side walls 130*a*, 130*b* include upper arms 140*a*, 140*b* and lower arms 142*a*, 142*b* on opposite sides of the respective slots 138*a*, 138*b*. As indicated in FIG. 12, upper surfaces 144*a*, 144*b* of the left and right side walls 130*a*, 130*b* (e.g., upper surface of the upper arms 140*a*, 140*b*) are chamfered or beveled toward the front side of the sway brace 110. The hold-down arm 125 sits on these upper surfaces 144*a*, 144*b*, as explained in more detail below, such that the hold-down arm is tilted or sloped downward toward the front side of the attachment 110.

As shown in FIG. 12, the side walls 130*a*, 130*b* (e.g., the upper arms 140*a*, 140*b*) define aligned and opposing openings 148*a*, 148*b*, respectively, disposed above the slots 138*a*, 138*b*. The openings 148*a*, 148*b* are sized and shaped to receive and capture the set screw bar 122 therein. In the illustrated embodiment, the openings 148*a*, 148*b* are generally rectangular, similar to the set screw bar 122, having a slightly larger area than the cross section of the bar so that the set screw bar is slidably receivable therein and captured. The openings 148*a*, 148*b* are configured such that when the bar 122 is received therein, the bar is tilted or sloped downward toward the front side of the attachment 10. In this way, as shown best in FIG. 15, a plane P2 of the bar 122 is angled relative to the axes A3 of the slots 138*a*, 138*b*. For example, the bar 122 may be angled between about 10 degrees and about 60 degrees, or about 15 degrees to about 30 degrees, or in one example about 15 degrees. As coupled to the side walls 130*a*, 130*b*, opposite end portions of the set screw bar 122 extend outward from the corresponding side walls 130*a*, 130*b* (e.g., upper arms of the corresponding side walls). The opposite ends of the bar 122 define openings 150 configured to receive set screws 152. The illustrated openings 150 are threaded to threadably receive the set screws 152. The axes A4 of the openings 150 (and axes of the fasteners, indicated by the same reference numeral) extend at an acute angle (i.e., less than 90 degrees) from the longitudinal axis of the bar 122 and the axis A3 defined by the slots 138*a*, 138*b* to enhance the strength of the connection to the beam or other structural support. In this way, the set screws 124 engage the flange of the structural support outside the body 120 and the channel 129 and at an angle less than 90 degrees (i.e., an acute angle) when threaded through the openings 150. For example, the set screws 124 may engage the flange at an angle from about 85 degrees to about 60 degrees, or from about 80 degrees to about 75 degrees. The set screws 124 may have torque off head that are sheared off the screws after a predetermined or threshold amount of torque is applied to the head.

Like the first embodiment of the hold-down arm 28, the present embodiment of the hold-down arm 128 includes a base 192 having first and second longitudinal ends. The base 192 can be generally rectangular in shape. Opposite first and second wings 194, 196 extend generally transverse to a longitudinal axis of base 192 at the respective first and second ends of the base 192. Together, interior faces of the base 192 and wings 194, 196 define a general U-shape and are sized and shapes to nest on top of the body 120, in particular, to sit or rest on the upper surfaces 144*a*, 144*b*. A fastener opening 198 (e.g., non-threaded opening) extends through the base 192 and is generally aligned with a threaded central opening 180 in the set screw bar 122 so that the threaded fastener 126 extends through the fastener opening 198 and threads into the opening 180 in the set screw bar to couple the hold-down arm 128 to the set screw bar 122 and position the hold-down arm relative to the lower flange 26. In addition, the set screws 124 extend through openings 182 (e.g., non-threaded openings) in the base 192 and thread into the threaded openings 150 in the set screw bar 122 to secure the support clamp 120 to the support 18. The axes A4 of the openings 150 (and axes of the fasteners, indicated by the same reference numeral) extend at an acute angle (i.e., less than 90 degrees) from the longitudinal axis of the base 192 of the hold-down arm 122 (and the bar plane P2) to enhance the strength of the connection to the beam or other structural support.

As secured to the body 120, the hold-down base 192 is tilted or sloped downward toward the front side of the hold-down 110. In this way, a plane P3 of the base 192 is angled relative to the axes A3 of the slots 138*a*, 138*b*. For example, the base 192 may be angled between about 10 degrees and about 60 degrees, or about 15 degrees to about 30 degrees, or in one example about 15 degrees. The first and second wings 194, 196 extend at an acute angle (i.e., less than 90 degrees), as indicated by axis A4, from the longitudinal axis (and plane P3) of the base 192 of the hold-down arm 122. Ends of the wings 194, 196 are also tapered to a point, although the ends of the wings may be blunt, such that portions of the ends are parallel to the axis A3.

Figure 13:
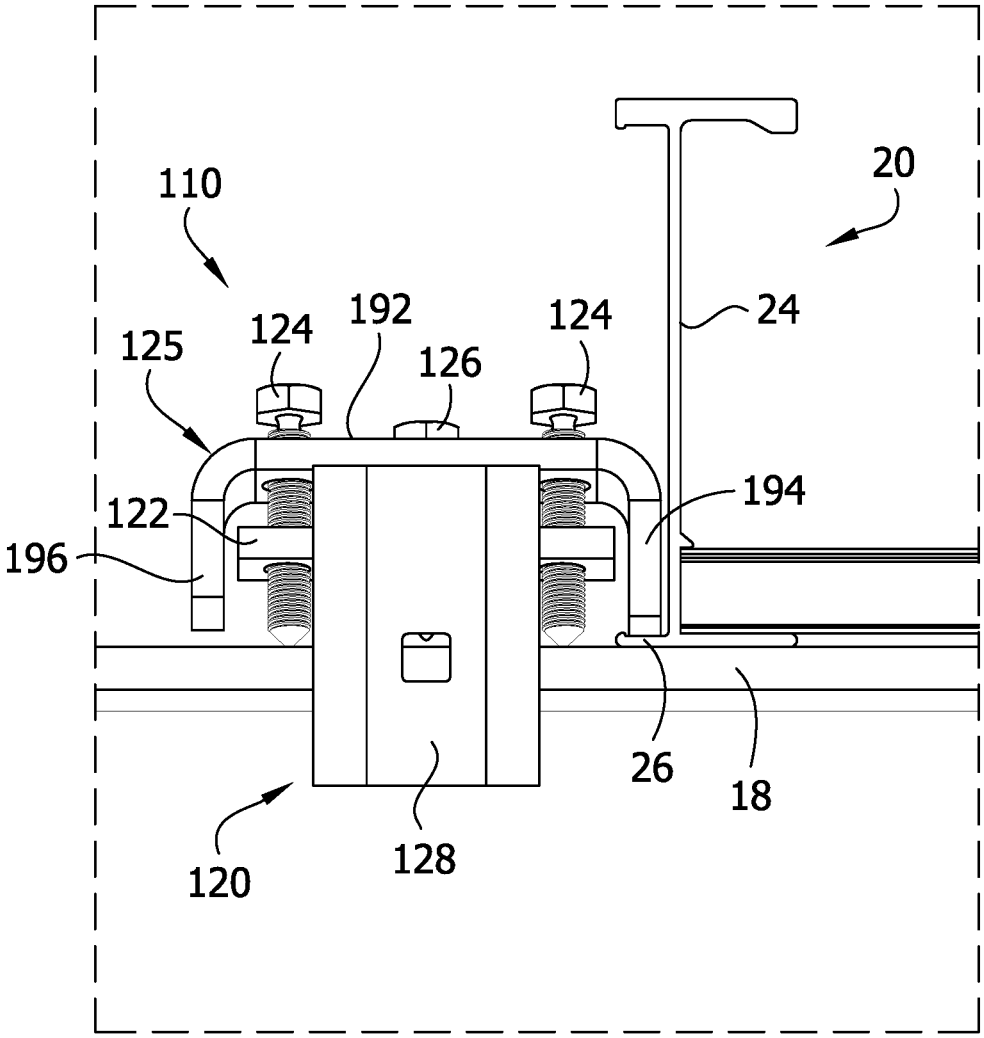
FIG. 13 is a front elevation of one of the hold-downs in a clamp configuration.

The first wing 194 extends further downward than the second wing 196 to define a clamping portion. The clamping portion is configured to engage and clamp the lower flange 26 of rail 20. In the illustrated embodiment, the clamping portion extends downward at an acute angle (i.e., less than 90 degrees) from the longitudinal axis (and plane P3) of the base 192 of the hold-down arm 122 (and the bar plane P2) to enhance the strength of the connection to the beam or other structural support, although it will be understood that the clamping portion could extend downward at a variety of angles. As illustrated in FIG. 13, the hold-down 110 is shown as mounted in the clamping configuration in which a portion of the base 192 overlies the lower flange 26 of the cable tray 12 and the first wing 194 is in clamping engagement with the flange 26 of the cable tray 12, thereby holding the rail 20 of the cable tray 12 in a fixed position relative to support 14.

Figure 14:
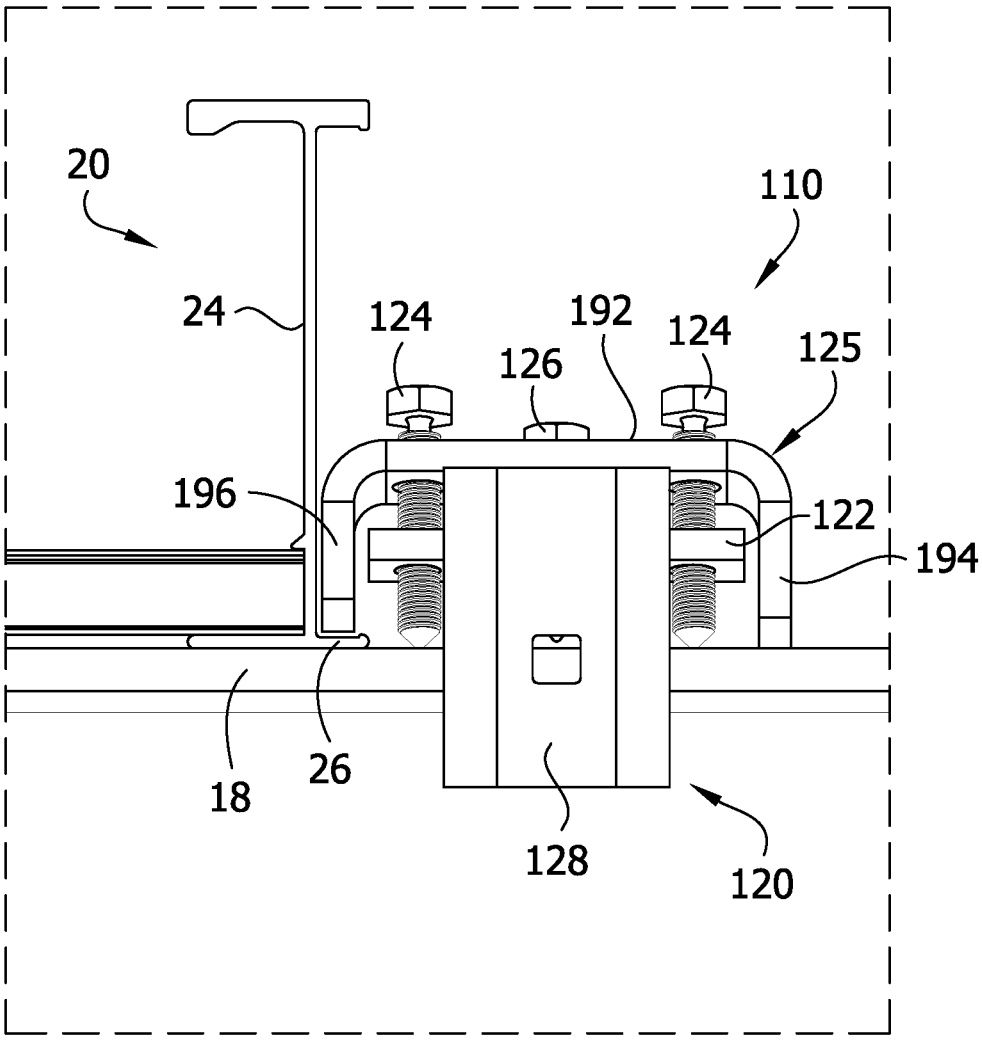
FIG. 14 is a front elevation of one of the hold-downs in a guide configuration.
Figure 15:
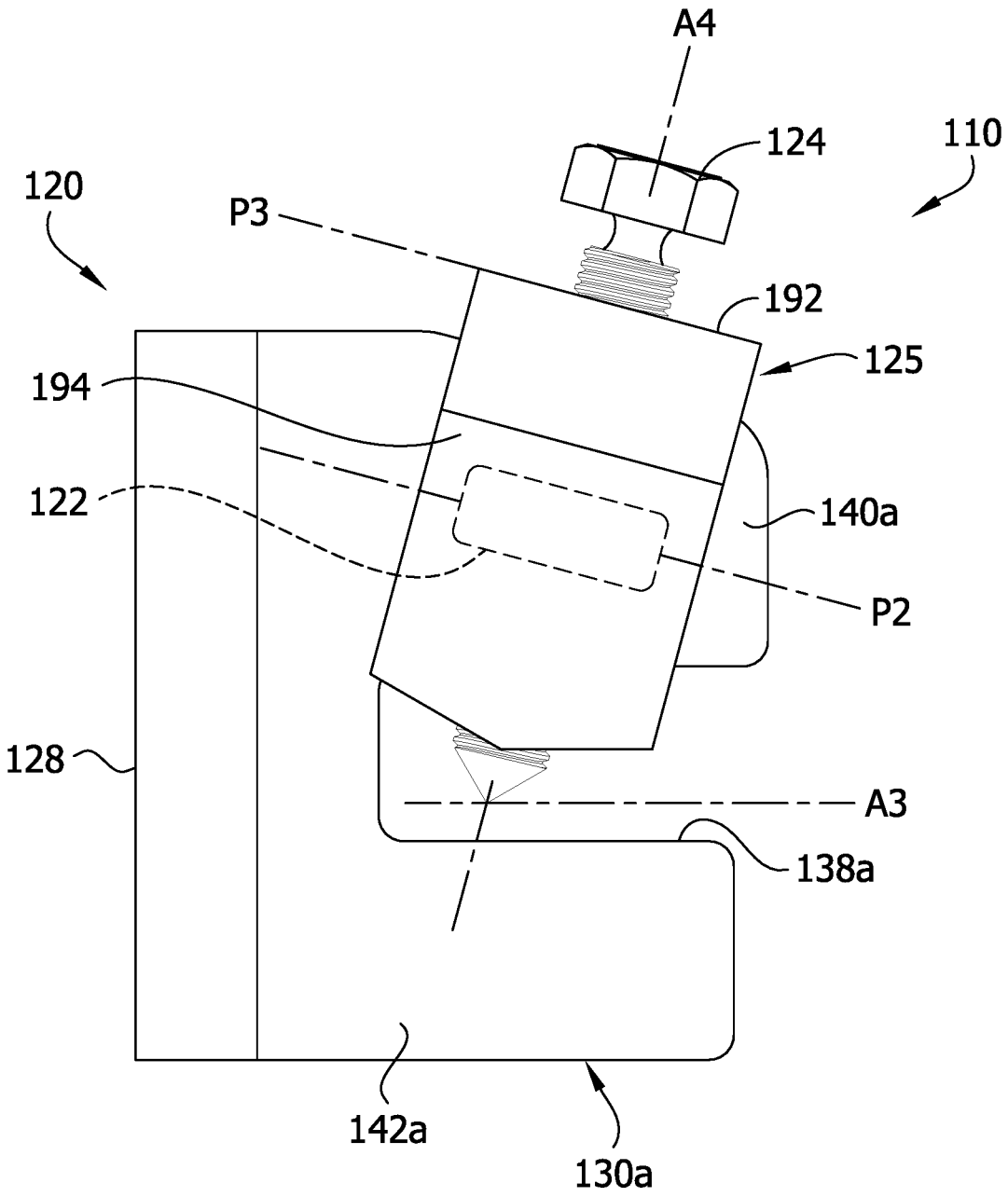
FIG. 15 is a first side view of the hold-down.
Figure 16:
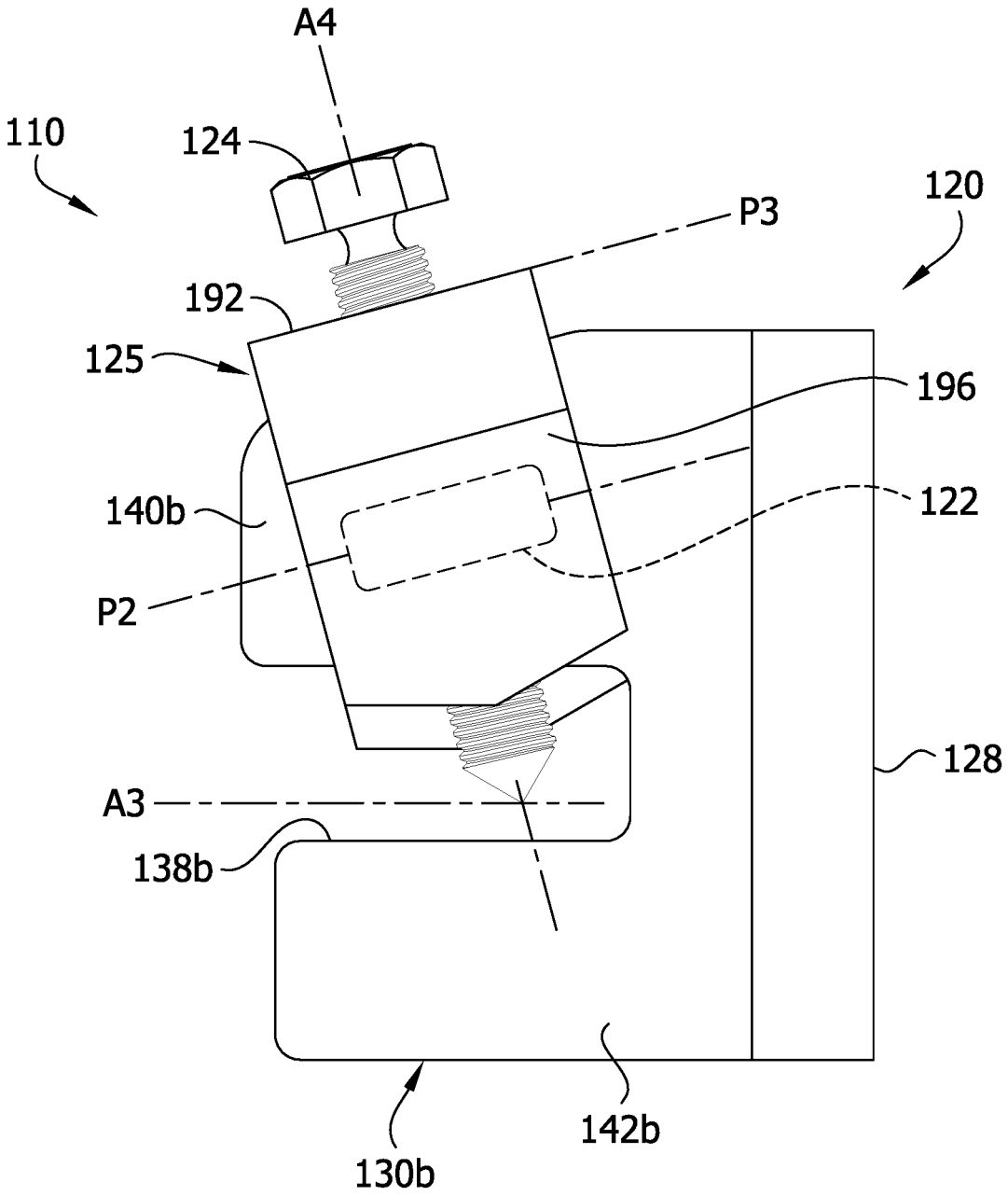
FIG. 16 is a second side view of the hold-down.

Referring to FIG. 14, the second wing 196 comprises the guide. In this configuration, the second wing 196 is not in clamping engagement with the rail 120 to permit free lengthwise thermal expansion and contraction of the rails relative to the support. The length of the second wing 196 is preferably sufficient to enable the second wing 196 to clear (but only slightly), the bead adjacent the outer edge of the lower flange 126. In this way, the second wing 196 is generally shorter in length than the first wing 194.

As can be understood and seen by FIGS. 13 and 14, the hold-down arm 128 can be orientated in either the clamp configuration (FIG. 13) or the guide configuration (FIG. 14) by merely rotating the hold-down arm 128 about a transverse axis extending transverse to the length of the hold-down 110 and through the opposite faces of the hold-down 110 so that either the clamp (first wing 194) engages the rail 126 or the guide (second wing 196) extends over the rail 126. There is no need to invert or flip over the hold-down arm 128. This makes orientating the hold-down easier and faster for the installer. To further enhance ease of use for the installer, the base 192 of the hold-down arm 198 can contain indicia 204 to indicate which side (i.e., which of the first and second wings 194, 196) functions as the clamp configuration and which functions as the guide configuration. This indicia 104 can also be contained on any other part of the hold-down 110 to indicate to the installer the proper orientation, for example, on first and second wings 194, 196.

The hold-down 110 is capable of withstanding a large force in multiple directions. For example, the hold-down 110 is capable of withstanding a large force applied transverse to the longitudinal axis of the cable tray 12 away from the support and transverse to the axis of support 14 away from the support ("tray pull-off" load). The hold-down 110 is also capable of withstanding a large force applied transverse to the longitudinal axis of the cable tray 12 and along the longitudinal axis of support 14 ("across the tray" load). Either or each of the tray pull-off load and the across the tray load may be over 2,000 lbf. (8,896 N), over 2,250 lbf. (10,008 N), over 2,500 lbf. (11,121 N), over 2,750 lbf. (12,233 N), over 3,000 lbf. (13,345 N), over 3,250 lbf. (14,457 N), or over 3,500 lbf. (15,569 N), for example, from 2,000 lbf. to 5,500 lbf. (8,896 N to 24,688 N), from 2,250 lbf. to 5,500 lbf. (10,008 N to 24,688 N), from 2,500 lbf. to 5,500 lbf. (11,121 N to 24,688 N), from 2,750 lbf. to 5,500 lbf. (12,233 N to 24,688 N), from 3,000 lbf. to 5,500 lbf. (13,345 N to 24,688 N), from 3,250 lbf. to 5,500 lbf. (14,457 N to 24,688 N), or from 3,500 lbf. to 5,500 lbf. (15,569 N to 24,688 N) in either or both the clamp and guide configurations.

Also provided herein is a method of securing a cable tray to a support, such that the cable tray is able to withstand a large force. The method generally comprises positioning the hold-down 110 in the correct configuration (i.e., clamp configuration or guide configuration) relative to the lower flange 26 of the rail 20 of cable tray 12 and sliding slots 130*a*, 130*b* of the support clamp 120 over the flange 18 of support 14. The fasteners 124 are tightened to secure the support clamp 120 to the flange 18. The fastener 126 is tightened to position the corresponding wing 194, 196 of the hold-down arm relative to the lower flange 26 of the rail 20.

In view of the above, it will be seen that several features of the disclosure are achieved and other advantageous results obtained.

Having described the disclosure in detail, it will be apparent that modifications and variations are possible without departing from the scope of the disclosure defined in the appended claims. For example, where specific dimensions are given, it will be understood that they are exemplary only and other dimensions are possible.

When introducing elements of the present disclosure or the preferred embodiment(s) thereof, the articles "a", "an", "the" and "said" are intended to mean that there are one or more of the elements. The terms "comprising", "including"

and "having" are intended to be inclusive and mean that there may be additional elements other than the listed elements.

As various changes could be made in the above constructions, products, and methods without departing from the scope of the disclosure, it is intended that all matter contained in the above description and shown in the accompanying drawings shall be interpreted as illustrative and not in a limiting sense.

The invention claimed is:

1. A hold-down for securing a cable tray to a support, the hold-down comprising:

a hold-down arm configured to retain a flange of a rail of the cable tray on the support without penetrating the flange or the support;

a support clamp configured to clamp onto the support, wherein the hold-down arm is coupled to the support clamp, wherein the support clamp includes a clamp body defining at least one slot configured to receive a flange of the support and includes a set screw bar coupled to the clamp body, wherein at least one set screw is threadably coupled to the set screw bar, wherein the at least one slot defines an axis along which the flange is slidably received in the at least one slot, and wherein an axis of the at least one set screw extends at an acute angle relative to the axis of the at least one slot;

wherein the hold-down is capable of retaining the cable tray on the support during application of a force over 3,000 lbf. when the force is applied in one or more of the following directions:

i) transverse to a longitudinal axis of the cable tray away from the support and transverse to a longitudinal axis of the support away from the support; or ii) ii) transverse to the longitudinal axis of the cable tray and along the longitudinal axis of the support.

2. The hold-down set forth in claim 1, wherein the set screw bar has opposite end portions disposed outside the body, each of the opposite end portions of the set screw bar defining a threaded opening extending through the set screw bar configured to receive respective set screws of the at least one set screw.

3. The hold-down set forth in claim 1, wherein the clamp body includes a back wall and opposing left and right side walls extending forward from the back wall, wherein the at least one slot includes slots defined by the left and right side walls.

4. The hold-down set forth in claim 1, wherein the clamp body is substantially channel-shaped having open upper and lower ends and an open front side.

5. The hold-down set forth in claim 4, wherein upper ends of the left and right side walls are chamfered downward toward the front side of the body, wherein the hold-down arm sits on the chamfered upper ends.

6. The hold-down set forth in claim 1, wherein the hold-down includes a first wing and a second wing, the first wing extending a length to clamp a lower flange of a rail of the cable tray, the second wing extending a shorter length than the length of the first wing to act as a guide over the lower flange of the rail of the cable tray.

7. The hold-down set forth in claim 6, wherein axes of the first and second wings extend at acute angles relative to the axis of the at least one slot.

8. The hold-down set forth in claim 7, wherein ends of the first and second wings are tapered.

9. A hold-down for securing a cable tray to a support comprising:

a support clamp including a clamp body defining at least one slot configured to receive a flange of the support, and a set screw bar coupled to the clamp body;

a hold-down arm coupled to the support clamp and comprising a first wing and a second wing, the first wing extending a length to clamp a lower flange of a rail of the cable tray, the second wing extending a shorter length than the length of the first wing to act as a guide over the lower flange of the rail of the cable tray; and at least one set screw threadably coupled to the set screw bar and configured to engage a flange of the support, wherein the clamp body includes a back wall and opposing left and right side walls extending forward from the back wall, wherein the at least one slot includes slots defined by the left and right side walls, and wherein upper ends of the left and right side walls are chamfered downward toward a front side of the body, wherein the hold-down arm sits on the chamfered upper ends.

10. The hold-down set forth in claim 9, wherein the set screw bar has opposite end portions disposed outside the clamp body, each of the opposite end portions of the set screw bar defining a threaded opening extending through the set screw bar configured to receive respective set screws.

11. A hold-down for securing a cable tray to a support, the hold-down comprising:

a hold-down arm configured to retain a flange of a rail of the cable tray on the support without penetrating the flange or the support;

a support clamp configured to clamp onto the support, wherein the hold-down arm is coupled to the support clamp, wherein the support clamp includes a clamp body defining at least one slot configured to receive a flange of the support, a set screw bar coupled to the clamp body, and at least one set screw threadably coupled to the set screw bar, wherein the clamp body is substantially channel-shaped having open upper and lower ends and an open front side, and wherein upper ends of the left and right side walls are chamfered downward toward the front side of the body, wherein the hold-down arm sits on the chamfered upper ends;

wherein the hold-down is capable of retaining the cable tray on the support during application of a force over 3,000 lbf. when the force is applied in one or more of the following directions:

i) transverse to a longitudinal axis of the cable tray away from the support and transverse to a longitudinal axis of the support away from the support; or ii) transverse to the longitudinal axis of the cable tray and along the longitudinal axis of the support.

* * * * *